United States Patent [19]

Gasser

[11] Patent Number: 4,590,646

[45] Date of Patent: May 27, 1986

[54] ASPIRATOR SYSTEMS

[75] Inventor: Hermann Gasser, Frauenfeld, Switzerland

[73] Assignee: Galipag, Frauenfeld, Switzerland

[21] Appl. No.: 624,610

[22] Filed: Jun. 26, 1984

[30] Foreign Application Priority Data

Jul. 6, 1983 [CH] Switzerland ..... 3703/83

[51] Int. Cl.[4] ..... D01H 5/60

[52] U.S. Cl. ..... 19/262; 19/263; 15/300 R; 15/415 R; 57/305

[58] Field of Search ..... 19/262, 263, 264, 245, 19/115, 218, 303; 15/300 R, 415, 409, 397, 395; 57/304, 305

[56] References Cited

U.S. PATENT DOCUMENTS 1,951,316 3/1934 Allen ..... 15/415

2,715,240 8/1955 Pieper et al. ..... 15/415

2,849,852 9/1958 Jacobi et al. ..... 19/263

3,045,415 7/1962 Bühler ..... 15/300 R X 4,223,518 9/1980 Karl et al. ..... 57/305 X

*Primary Examiner*—Louis K. Rimrodt

*Assistant Examiner*—J. L. Olds

*Attorney, Agent, or Firm*—Benoit Law Corporation

[57] ABSTRACT

In order to remove broken threads and debris from textile drawing equipment having a drawing cylinder, a suction pipe connected to an air pressure sink is provided with a triangular suction opening at the drawing cylinder for removing the broken threads and debris. For substantially improved performance at essentially the same air throughput, the suction pipe, in continuation of its triangular suction opening, is provided with a triangular cross-section being congruent with the triangular suction opening and extending along a major portion of the length of the suction pipe, such as to the vicinity of its connection to the air pressure sink.

21 Claims, 4 Drawing Figures

ASPIRATOR SYSTEMS

BACKGROUND OF THE INVENTION

1. Field of the Invention

The subject invention relates to suction pipes or aspirators and, more particularly, to aspirators for textile machines or yarn drawing equipment.

2. Information Disclosure Statement

For a long time, textile yarn drawing equipment for spinning machines has been equipped with aspirators for maintaining the working parts clean and for removal of torn threads. In this respect, cylindrical suction pipes have been employed and have been associated at their front end or suction opening with a cylinder of the drawing works, while being connected at their opposite rear end with an air pressure sink or pumping arrangement. Since the cross-section of such suction pipes is chosen to be as narrow as possible, in order to maintain low air consumption, while the torn threads are, however, only picked up reliably in the projected extension of the suction opening, part of the material to be removed is not apprehended by the available suction.

In an effort to enlarge the range of action without enlargement of the cross-section of the suction pipe, it has already been proposed to utilize a suction pipe with triangular cross-section. One edge of the suction opening of that suction pipe is arranged in parallel to the axis of the cylinder serving as guiding surface for the air stream, whereby the air is aspired primarily from that cylinder. Since such triangular configuration is, however, aerodynamically unfavorable and in particular causes the formation of eddy currents or turbulence, that known cylindrical suction pipe has adjacent its suction opening a constricted cross-section changing into an enlargement for improved aerodynamics. However, that known suction pipe is strongly subject to clogging and a removal of threads causing such congestion is rather cumbersome.

SUMMARY OF THE INVENTION

It is a general object of this invention to overcome the disadvantages and to meet the needs expressed or implicit in the Information Disclosure Statement or in other parts hereof.

It is a related object of this invention to provide improved aspirators, suction techniques and suction pipes, in which congestability is reduced without increase of air consumption.

It is a germane object of this invention to provide improved aspirator systems, textile drawing equipment, and methods for removing broken threads and debris therefrom.

Other objects will become apparent in the further course of this disclosure.

In its realization of these objects, the subject invention first overcame the prejudice in the art against a choice of a triangular configuration for the cross-section of suction pipes. In particular, the choice of a triangular configuration in the manner and to the extent of the subject invention contradicts the general efforts of those skilled in the art to provide suction pipes with as aerodynamically favorable properties as possible; which heretofore led to the then prevailing opinion that a cylindrical suction pipe was best.

In the realization of its objects, the subject invention also had to overcome the difficulty that the aerodynamic evaluation of triangular configurations is encumbered by the fact that it is aerodynamically not the dimensions of the triangle, but rather the diameter of the inscribed circle, that determines attainable flow.

According to one aspect thereof, the subject invention resides in an aspirator comprising means for removing broken threads and debris from textile drawing equipment, including a suction pipe having at a front end a triangular opening and having in continuation of that triangular suction opening a triangular cross-section at right angles to a longitudinal axis of the suction pipe, the triangular cross-section being congruent with the triangular suction opening and extending along a major portion of the length of the suction pipe which can be the whole length of said suction pipe.

It is exactly that extension of the triangular configuration from the suction opening over the major extent of the suction pipe that enables an inhibition of congestion or clogging of the pipe by dust or torn threads during suction, without any increase in the air throughput. This inventor is of the opinion that the larger clearance of the suction pipe at the corner of the triangular configuration beyond the aerodynamically determinant diameter of the inscribed circle is decisive for the effective operation of the subject invention. This difference between aerodynamically effective and actual physical diameters permits operation with air volumes or throughputs similar to those permissible for cylindrical suction pipes, the diameter of which is equal to the inscribed circle of the triangular cross-section, while simultaneously providing the larger physical clearance of the extended triangular section according to the subject invention. In addition to thus providing a larger area for the effective removal of torn threads and debris, the extended triangular configuration according to the subject invention also promotes the occurrence of such eddies and turbulence at the suction opening as to reduce the probability of threads coming to lie transversely to the suction opening where they could constitute an increased risk of congestion or clogging.

The triangular configuration herein disclosed subjects the air stream and thereby the particles entrained thereby to a centering action which may be augmented by providing the suction pipe with sharp edges at the suction opening according to a preferred embodiment of the subject invention. By virtue of this centering action, and the air deflection at the pipe edges which are not parallel to the cylinder axis, a contraction of the sucked-in air stream occurs which can be compared in effect to the action of a funnel tapering in the direction of the suction opening. By virtue of this funneling action, which amounts to an enlargement of the field of suction, not only threads located in the extended projection of the suction pipe, but also threads in the vicinal region, are reliably reached for removal by suction. Accordingly, the funneling action of the subject invention also guarantees an apprehension of broken threads in the usual case of yarn running, in addition to the direction of delivery also over wide amplitudes, transversely back and forth between relatively widely spaced limits, as is the case in spinning and yarn stretching machines.

According to a preferred embodiment, the mostly triangular shape of the suction pipe passes over into a round cross-section, which facilitates connection of the suction pipe to a pump or other air pressure sink or a preferably yieldable mounting of the suction pipe in an elastomeric or rubber cuff.

From another aspect thereof, the subject invention resides in an aspirator for textile drawing equipment having a drawing cylinder and comprising at least one suction pipe connected to an air pressure sink and having a triangular suction opening at the drawing cylinder for removing broken threads and debris. The suction pipe, in continuation of its triangular suction opening, has a triangular cross-section at right angles to a longitudinal axis of the suction pipe, the triangluar cross-section being congruent with the triangular suction opening and extending along a major portion of the length of said suction pipe.

The expression "aspirator" as herein employed may refer either to the suction pipe itself or to an aspirator system including the suction pipe.

From a further aspect thereof, the subject invention resides in a method of removing broken threads and debris from textile drawing equipment having a drawing cylinder, comprising, in combination, the steps of providing at least one suction pipe with a triangular suction opening at the drawing cylinder for removing broken threads and debris, providing the suction pipe in continuation of its triangular suction opening with a triangular cross-section at right angles to a longitudinal axis of the suction pile, the triangular cross-section being congruent with the triangular suction opening and extending along a major portion of the length of the suction pipe, and connecting the suction pipe to an air pressure sink.

Other aspects of the invention will become apparent in the further course of this disclosure, and no restriction to any aspect or feature is intended by the subject Summary of the Invention.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
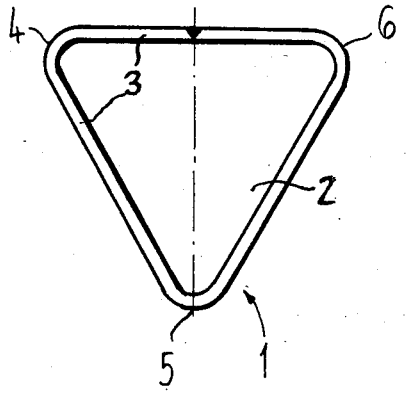
FIG. 1 is a top view on an enlarged scale of the suction pipe according to FIG. 2 at its suction opening.
Figure 2:
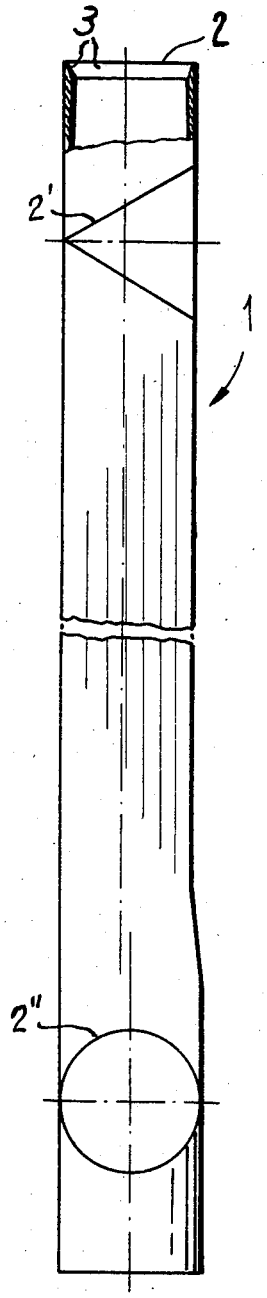
FIG. 2 is a side view of the suction pipe according to a preferred embodiment of the subject invention.

According to the preferred embodiment illustrated in FIGS. 1 to 4, the suction pipe 1 has an equilaterally triangular cross-section indicated in FIG. 2 schematically at 2', and a like triangular suction opening 2 having sharp edges 3 at one of the ends of the pipe for realizing the above mentioned centering effect. The other pipe end is connected to an air pressure sink diagrammatically shown at 10, and has a round cross-section schematically indicated in FIG. 2 at 2''. In this respect, the ratio of the length of the pipe section with round cross-section to the total length of the suction pipe preferably is about 2:10. In other words about 80% of the length of the suction pipe 1, from the suction opening 2 on, are preferably triangular in cross-section according to the expressed preference of the subject invention.

Qualitatively speaking, the triangular cross-section 2' extends preferably to the vicinity of the connection of the suction pipe to the air pressure sink or vacuum exhaust system, and changes to a circular or similar cross-section 2'' in that vicinity so as to facilitate connection of the suction pipe 1 to the pressure sink. Reference should in this respect also be had to the extensive description set forth above in the Summary of the Invention of the reasons for and effects of the extension of the triangular cross-section 2' beyond the suction opening 2 and along most of the suction pipe 1.

While the aerodynamically ideal configuration of the triangular section of the suction pipe has flat surfaces and sharp corners, rounded corners and bent surfaces as practical may be provided instead. By way of example, the corners or apexes 4, 5 and 6 of the suction pipe 1 are rounded internally, as well as externally, according to FIG. 1.

In this respect, the suction pipe 1 may be formed by connecting a flat piece and a V-shaped piece of sheet metal, by pressing a tube of round cross-section, or by bending of sheet metal and interconnection of the abutting edges. Hard-rolled stainless steel is preferred as material for the suction pipe 1, because of its durability against mechanical action. For suction pipes with large cross-section or exposure to high wear, such as in the case of hard yarns, the pipe 1 may be provided with a ceramic oxide film at the suction opening 2.

Because of its continuation of the triangular configuration of the suction opening over the major part of the length of the suction pipe, the subject invention avoids congestion of the pipe, while at the same time keeping the air consumption low. By way of example, the illustrated aspirator, at air speeds of 25 to 35 m/sec., reliably untangles thread loops or loop sections sucked in upon a break in the thread. Also, any occurring congestion is removed without problem from the suction pipe according to the subject invention.

The aspirator according to the subject invention is particularly suited for thread or yarn drawing equipment in ring spinning machines. A familar type of drawing machine is shown at 7 in FIGS. 3 and 4 and will be recognized by those skilled in the art as being of the famous "Rieter" type.

Figure 3:
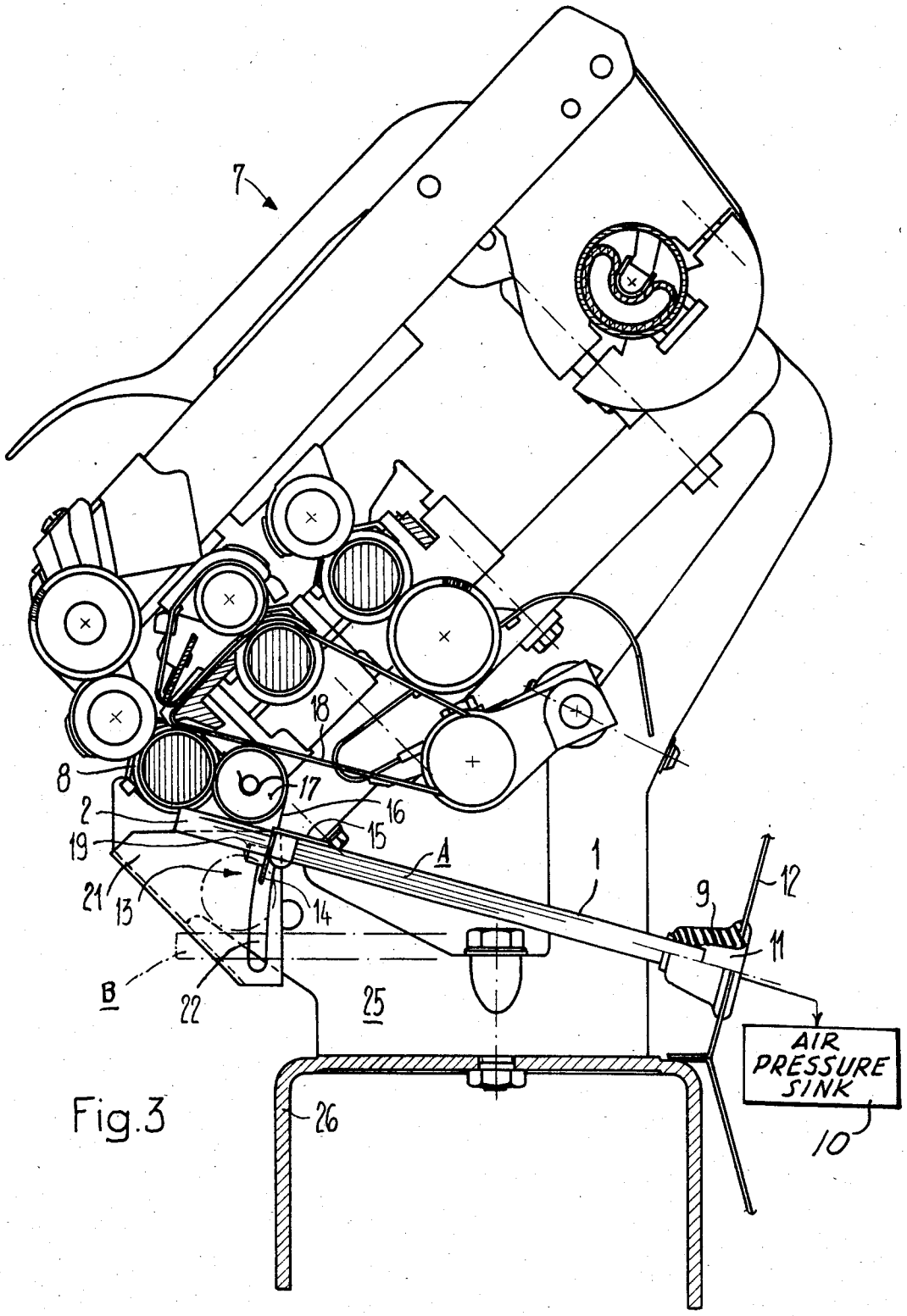
FIG. 3 is a side view, partially in section, of a yarn drawing machine including the suction pipe according to a preferred embodiment of the subject invention.
Figure 4:
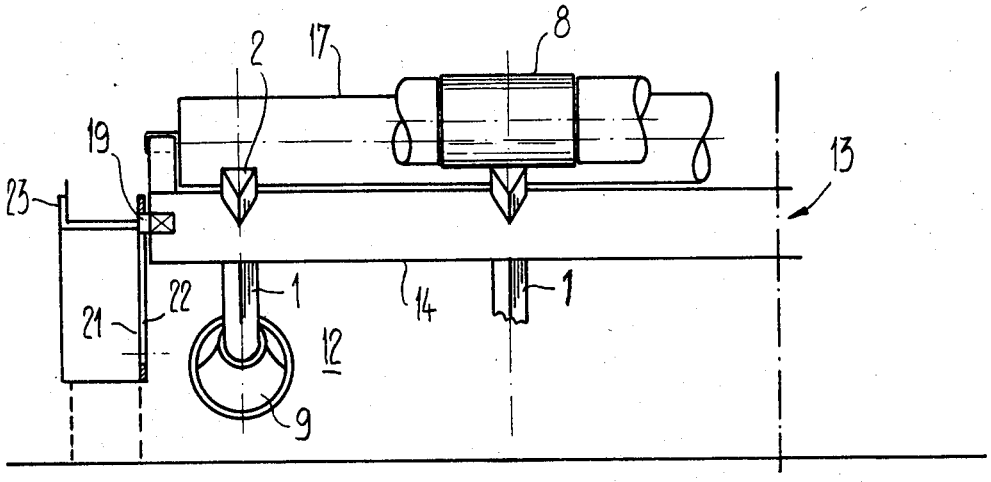
FIG. 4 is part of an elevation of the combination according to FIG. 3.

According to FIGS. 3 and 4, the suction pipe 1 is associated with the lower supply cylinder 8 of that well-known "Rieter" drawing machine. A connection cuff 9 of flexible and preferably elastic synthetic material or rubber mounts the suction pipe 1 yieldably at the rear end of the pipe associated with the air pressure sink or pumping system 10.

The connection cuff 9, in turn, is held at an opening 11 in the wall 12 of the air pressure sink 10 and thereby connects that sink or pumping system to the suction pipe 1. The end section of the pipe 1 at the suction opening 2 perpendicularly penetrates the downwardly extending leg 14 of the rectangularly bent sheet-metal structure 13. The leg 15 of the sheet-metal structure, which is parallel to the suction pipe 1, is arranged above that suction pipe and is equipped with a bent spring 16. That spring 16 carries a cleaning roller 17 pressed against the lower supply cylinder 8 and against a tensioning belt 18. In this manner, the cleaning roller 17 is in frictional engagement with the supply roller 8 and the tensioning belt 18 to be dragged along therewith for continuously cleaning the supply cylinder.

As indicated in FIG. 4, each aspirator assembly comprises more than one suction pipe 1, all of which are held by the same mounting structure 13. In this manner, each drawing work 7 or grooved supply cylinder 8 has a suction pipe associated therewith.

The suction pipes 1 penetrating the sheet-metal structure 13 at 14 and being yieldably mounted at the side of the air pressure sink, are tiltable between an upper active position A shown in solid outline, and a lower rest position B shown in phantom outline.

Lateral flanges, one of which is seen at 21 in FIGS. 3 and 4, are arranged on the frame 25 carried by the machine bed 26. Each of these sheet-metal flanges 21 has an elongate hole 22 for receiving a guiding bolt 19 projecting from the pipe mounting structure 13.

For a tilting of the suction pipe and mounting structure 13, the guiding bolt 19, which is outside the hole 22 in the working position A, is pressed into the elongate hole 22 and is moved downwardly with the actuator handle 23. The cleaning roller 17, mounted with the spring 16 on the leg 15 and extending over several drawing works, is thereby disengaged from its frictional engagement with the supply cylinder 8 and tensioning belt 18, and is moved downwardly. In that downward position, the cleaning roller 17 rests only in a curvature of the bent spring 16, and is, therefore, upwardly liftable and removable.

During its return to the working position A, the suction pipe and thereby the guiding bolt 19 are pressed by the elastic connecting cuff 9 in the direction of the band of threads. The guiding bolt 19 thereby comes to lie outside the extent of the elongate hole 22 and arrests the suction pipe 1 in that position.

In general terms, when the aspirator arrangement is used as herein disclosed, the suction pipe 1 is preferably associated with the lower supply cylinder roller 8 of the drawing works 7. In that arrangement, the suction pipe 1 may simultaneously carry a cleaning device, such as a cleaning roller 17 or a wiping blade for the supply roller 8. That cleaning organ executes the same movement as the suction pipe, when that suction pipe 1 is moved from its working position A to the preferably lower rest position B.

One of the three sides of the triangular suction pipe 19 may project beyond the corners 4 and 5, for instance, of the triangular cross-section, whereby a rail-like projection is formed on both sides of the pipe 1, which facilitates the spatial orientation, such as the mounting and guidance of the suction pipe, as well as the arrangement of further elements, such as the cleaning roller 17.

The combination of suction pipe 1 and machine 7 herein disclosed carries out a method of removing broken threads and debris from textile drawing or processing equipment and also constitutes a particular use of the suction pipe 1 as herein disclosed.

The cleaning roller 17 shown in FIGS. 3 and 4 may be viewed as an additional device for cleaning the drawing cylinder 8. Such additional cleaning device is mounted on the suction pipe or pipes 1 and is carried with such suction pipe or pipes into proximity to that drawing cylinder.

Other variations and modifications within the spirit and scope of the subject invention will become apparent or be suggested to those skilled in the art by the subject extensive disclosure.

I claim:

1. An aspirator comprising:

means for removing broken threads and debris from textile drawing equipment, including a suction pipe having at a front end a triangular suction opening and having in continuation of said triangular suction opening a triangular cross-section at right angles to a longitudinal axis of said suction pipe, said triangular cross-section being congruent with said triangular suction opening and extending along a major portion of the length of said suction pipe.

2. An aspirator as claimed in claim 1, wherein:

said suction opening and said cross-section of the suction pipe are equilaterally triangular in shape.

3. An aspirator as claimed in claim 1, wherein:

said suction opening is delimited by sharp edges.

4. An aspirator as claimed in claim 3, wherein:

said suction opening and said cross-section of the suction pipe are equilaterally triangular in shape.

5. An aspirator as claimed in claim 1, wherein:

said triangular suction opening and said triangular cross-section have rounded apexes.

6. An aspirator as claimed in claim 1, wherein:

said suction pipe changes in cross-section toward an end of the suction pipe opposite said suction opening from said triangular to a round configuration.

7. An aspirator as claimed in claim 1, including:

a cleaning device carried by said suction pipe.

8. An aspirator as claimed in claim 1, including:

means for tilting said suction pipe between a working position and a rest position.

9. An aspirator for textile drawing equipment having a drawing cylinder, comprising:

at least one suction pipe connected to an air pressure sink and having a triangular suction opening at said drawing cylinder for removing broken threads and debris, said suction pipe having in continuation of said triangular suction opening a triangular cross-section at right angles to a longitudinal axis of said suction pipe, said triangular cross-section being congruent with said triangular suction opening an extending along a major portion of the length of said suction pipe.

10. An aspirator as claimed in claim 9, wherein:

said suction opening, and said cross-section of the suction pipe are equilaterally triangular in shape.

11. An aspirator as claimed in claim 9, wherein:

said suction opening is delimited by sharp edges.

12. An aspirator as claimed in claim 11, wherein:

said suction opening and said cross-section of the suction pipe are equilaterally triangular in shape.

13. An aspirator as claimed in claim 9, wherein:

said triangular suction opening and said triangular cross-section have rounded apexes.

14. An aspirator as claimed in claim 9, wherein:

said suction pipe changes in cross-section toward an end of the suction pipe opposite said suction opening from said triangular to a round configuration.

15. An aspirator as claimed in claim 9, including:

a device carried by said suction pipe for cleaning said drawing cylinder.

16. An aspirator as claimed in claim 1, including:

means for tilting said suction pipe relative to said drawing cylinder between a working position and a rest position.

17. A method of removing broken threads and debris from textile drawing equipment having a drawing cylinder, comprising in combination the steps of:

providing at least one suction pipe with a triangular suction opening at said drawing cylinder for removing said broken threads and debris, providing said suction pipe in continuation of said triangular suction opening with a triangular cross-section at right angles to a longitudinal axis of said suction pipe, said triangular cross-section being congruent with said triangular suction opening and extending along a major portion of the length of said suction pipe; and connecting said section pipe to an air pressure sink.

18. A method as claimed in claim 17, wherein:

said suction opening and said cross-section of the suction pipe are made equilaterally triangular in shape.

19. A method as claimed in claim 17, including the step of:

imposing a centering action on an air stream in said suction pipe by delimiting said suction opening with sharp edges.

20. A method as claimed in claim 17, including the steps of:

providing an additional device for cleaning said drawing cylinder;

mounting said additional device on said suction pipe; and carrying said additional device with said suction pipe into proximity to said drawing cylinder.

21. An aspirator comprising:

a suction pipe having at a front end a triangular suction opening and having in continuation of said triangular suction opening a triangular cross section being congruent with said triangular suction opening and extending along the whole length of said suction pipe.

* * * * *